US006179404B1

(12) United States Patent
Kawarama et al.

(10) Patent No.: US 6,179,404 B1
(45) Date of Patent: Jan. 30, 2001

(54) INK JET RECORDING APPARATUS AND CAP FOR SUCH APPARATUS

(75) Inventors: Makoto Kawarama, Kawasaki; Hitoshi Sugimoto, Yokohama, both of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/422,794

(22) Filed: Oct. 22, 1999

(30) Foreign Application Priority Data

Oct. 27, 1998 (JP) ..... 10-306177

(51) Int. Cl.[7] ..... B41J 2/165
(52) U.S. Cl. ..... 347/31
(58) Field of Search ..... 347/31, 30, 29

(56) References Cited

U.S. PATENT DOCUMENTS

| | | | |
|---|---|---|---|
| 5,798,775 | 8/1998 | Takahashi et al. | 347/33 |
| 6,017,109 | 1/2000 | Saijo | 347/30 |

FOREIGN PATENT DOCUMENTS

| | | | |
|---|---|---|---|
| 0 435 666 | 7/1991 | (EP) . | |
| 0 744 294 | 11/1996 | (EP) . | |
| 7-290723 * | 11/1995 | (JP) | B41J/2/18 |
| 8-318624 | 12/1996 | (JP) . | |
| 10-244707 | 8/1998 | (JP) | B41J/2/165 |
| 11-138855 | 5/1999 | (JP) | B41J/2/175 |

* cited by examiner

*Primary Examiner*—David F. Yockey
(74) *Attorney, Agent, or Firm*—Fitzpatrick, Cella, Harper & Scinto

(57) ABSTRACT

The present invention provides an ink jet recording apparatus comprising a cap member capable of sealing a discharge port for discharging ink and being provided at its bottom with an ink suction opening and an atmosphere communicating opening, an ink absorbing member disposed within the cap member, a suction pump communicated with the ink suction opening, and an atmosphere communicating valve communicated with the atmosphere communicating opening, and wherein areas of the ink absorbing member opposed to the ink suction opening and the atmosphere communicating opening are thinner than the other area and the ink absorbing member abuts against the ink suction opening.

14 Claims, 9 Drawing Sheets

INK JET RECORDING APPARATUS AND CAP FOR SUCH APPARATUS

BACKGROUND OF THE INVENTION

1. Field of the Invention

The present invention relates to an ink jet recording apparatus for effecting recording on a recording medium by discharging ink from a recording means, and a cap for such an apparatus.

The present invention can be applied to an apparatus such as a printer, a copying machine, a facsimile having a communication system or a word processor having a printer portion for effecting recording on a recording medium such as a paper sheet, thread, fibers, cloth leather, metal, plastic, glass, wood or ceramics and to an industrial recording apparatus in which various processing devices are combined in a composite manner. Here, the word "recording" means not only to afford an image such as characters or figures which are meaningful to a recording medium but also to afford an image such as a pattern which is meaningless to a recording medium.

2. Related Background Art

An ink jet recording system has been used with printers and copying machines because of low noise, low running cost, easiness of compactness and easiness of colorization.

In the past, in ink jet recording apparatus, for the purpose of preventing ink clogging of discharge ports of a recording head due to solidification of ink or increase in ink viscosity caused by the drying of ink, the discharge ports of the recording head have been shielded from atmosphere, or, for the purpose of recovering clogging of discharge ports due to solidification of ink or increase in ink viscosity or bubbles or foreign matters generated in liquid passages, a suction recovering operation for forcibly discharging ink by generating pressure at the discharge openings has been performed. For example, as an example of such a suction recovering operation, a cap member is closely contacted with a discharge port surface of a recording head and ink is sucked from the recording head by generating negative pressure within the cap member and thereafter the ink remaining in the cap is sucked (idle suction) by communicating the interior of the cap with the atmosphere. Further, as another example, in order to prevent scattering of ink from the cap to the discharge ports of the recording head during the suction and to such the ink remaining around the discharge ports of the recording head, an ink absorbing member made of porous material for absorbing the ink is disposed within the cap member.

However, recently, in the ink jet recording systems, high quality recorded images have been requested and improvement in water-resistance and light-resistance of ink has been made. For example, various inks such as ink which becomes water-soluble (to water) after drying or ink including pigment as coloring agent have been used. Some of such inks increases its viscosity to loose fluidity (for example, becomes gel) after it is dried due to vaporization.

After an image was printed on a recording sheet by using the recording head utilizing the above-mentioned ink, if next recording is not effected for a long term, i..e, if the discharge ports of the recording head are kept in the sealed condition by the cap for a long term, small amount of ink remaining in the ink absorbing member after the previous suction recovery may be solidified in the ink absorbing member or may cause clogging. As a result, even when the suction recovery is effected to prepare for next recording, predetermined pressure does not act on the recording head not to suck the ink from the recording head sufficiently or the interior of the cap becomes hard to be communicated with the atmosphere not to achieve the suction of ink (idle suction), thereby not realizing the normal or optimum suction recovery.

SUMMARY OF THE INVENTION

An object of the present invention is to provide an ink jet recording apparatus and a cap for such an apparatus, in which, even when discharge ports of a recording head are sealed for a long term, a recovering operation for the recording head can surely be effected.

Another object of the present invention is to provide an ink jet recording apparatus comprising a cap member capable of sealing discharge ports of a recording head and being provided at its bottom with an ink suction opening and an atmosphere communicating opening, an ink absorbing member disposed within the cap member, a suction pump communicated with the ink suction opening, and an atmosphere opening valve communicated with the atmosphere communicating opening, and wherein areas of the ink absorbing member opposed to the ink suction opening and the atmosphere communicating opening are thinner than the other area and the ink absorbing member abuts against the ink suction opening.

A further object of the present invention is to provide a cap for an ink jet recording apparatus comprising a cap member capable of sealing discharge ports of a recording head and being provided at its bottom with an ink suction opening communicated with a suction pump and an atmosphere communicating opening communicated with an atmosphere opening valve, and an ink absorbing member disposed within the cap member, and wherein areas of the ink absorbing member opposed to the ink suction opening and the atmosphere communicating opening are thinner than the other area and the ink absorbing member abuts against the ink suction opening.

In the present invention, when ink is sucked from the recording head, an amount of ink remaining in the ink absorbing member can be reduced. Even when the apparats is left as it is for a long term without recording, occurrence of ink solidification and clogging of the ink absorbing member can be reduced. If ink solidification or clogging should be partially generated in the ink absorbing member, after the ink starts to flow once, solidified or clogged ink becomes apt to be solved again from the thinner area of the ink absorbing member. Further, after the ink suction from the recording head, when the interior of the cap member is communicated with the atmosphere, the atmosphere can easily be communicated with the interior of the ink absorbing member, thereby effecting the suction of the residual ink (idle suction) positively. As a result, the recovering operation for the recording head can be effected positively.

DETAILED DESCRIPTION OF THE PREFERRED EMBODIMENTS

The present invention will now be explained in connection with embodiments thereof with reference to the accompanying drawings.

First Embodiment

Figure 1:
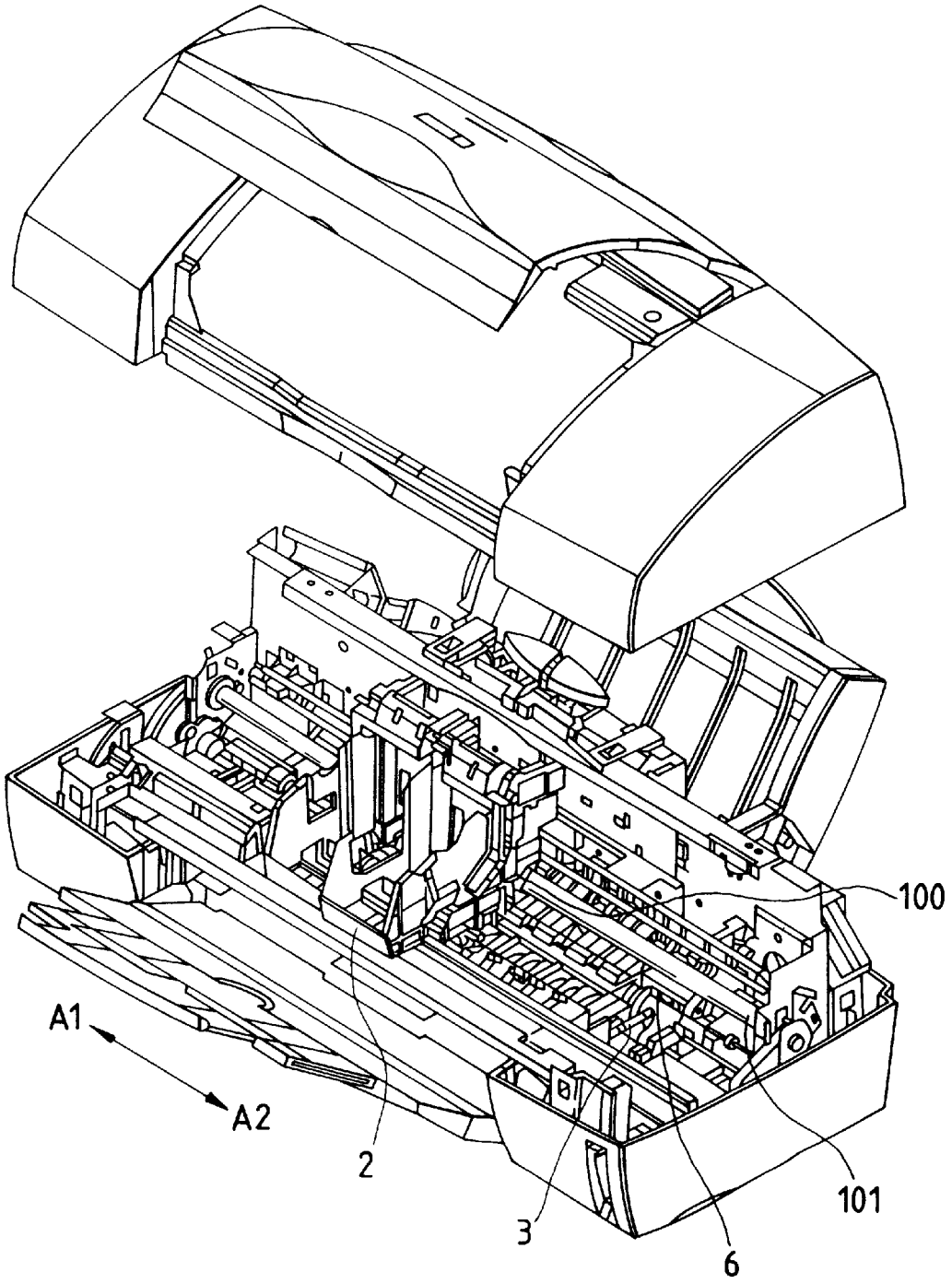
FIG. 1 is a perspective view showing the entire construction of an ink jet recording apparatus according to a first embodiment of the present invention.
Figure 2:
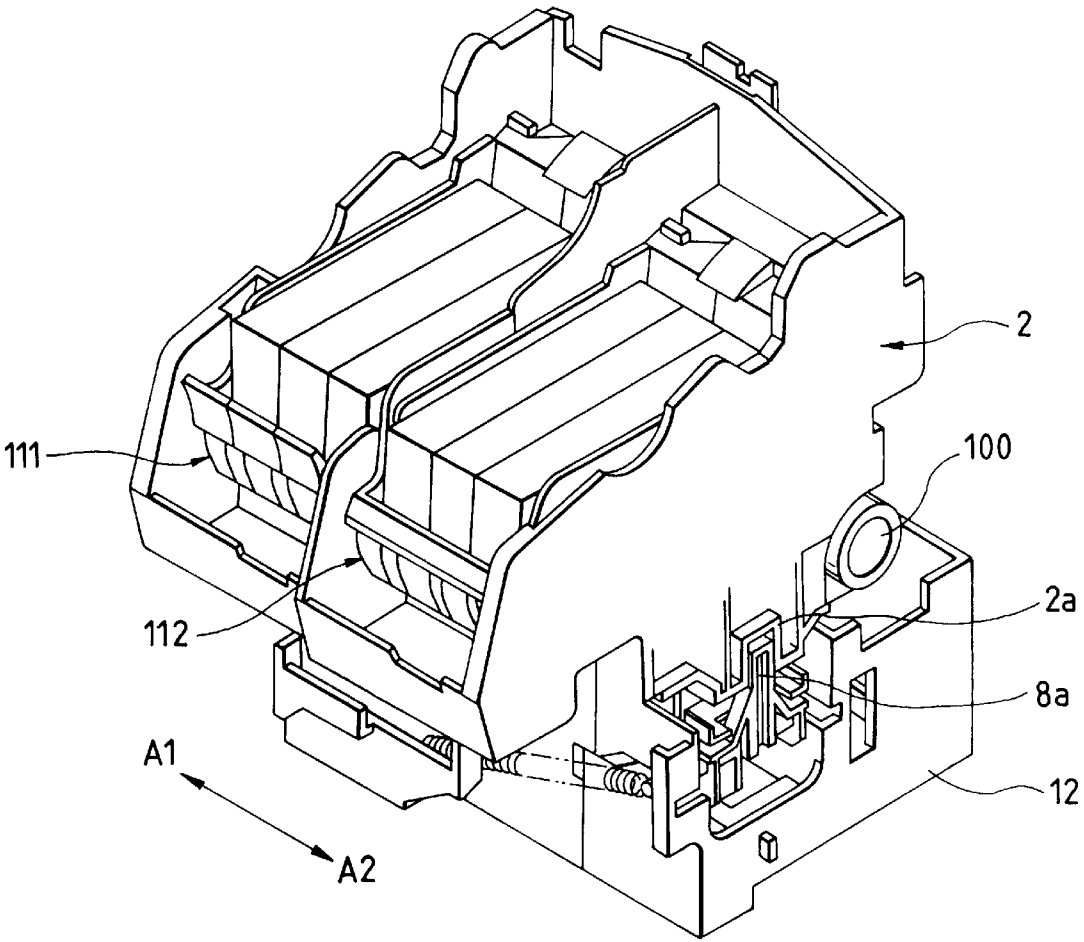
FIG. 2 is a perspective view showing a carriage of FIG. 1 and a recovering unit for a recording head mounted on the carriage.
Figure 3:
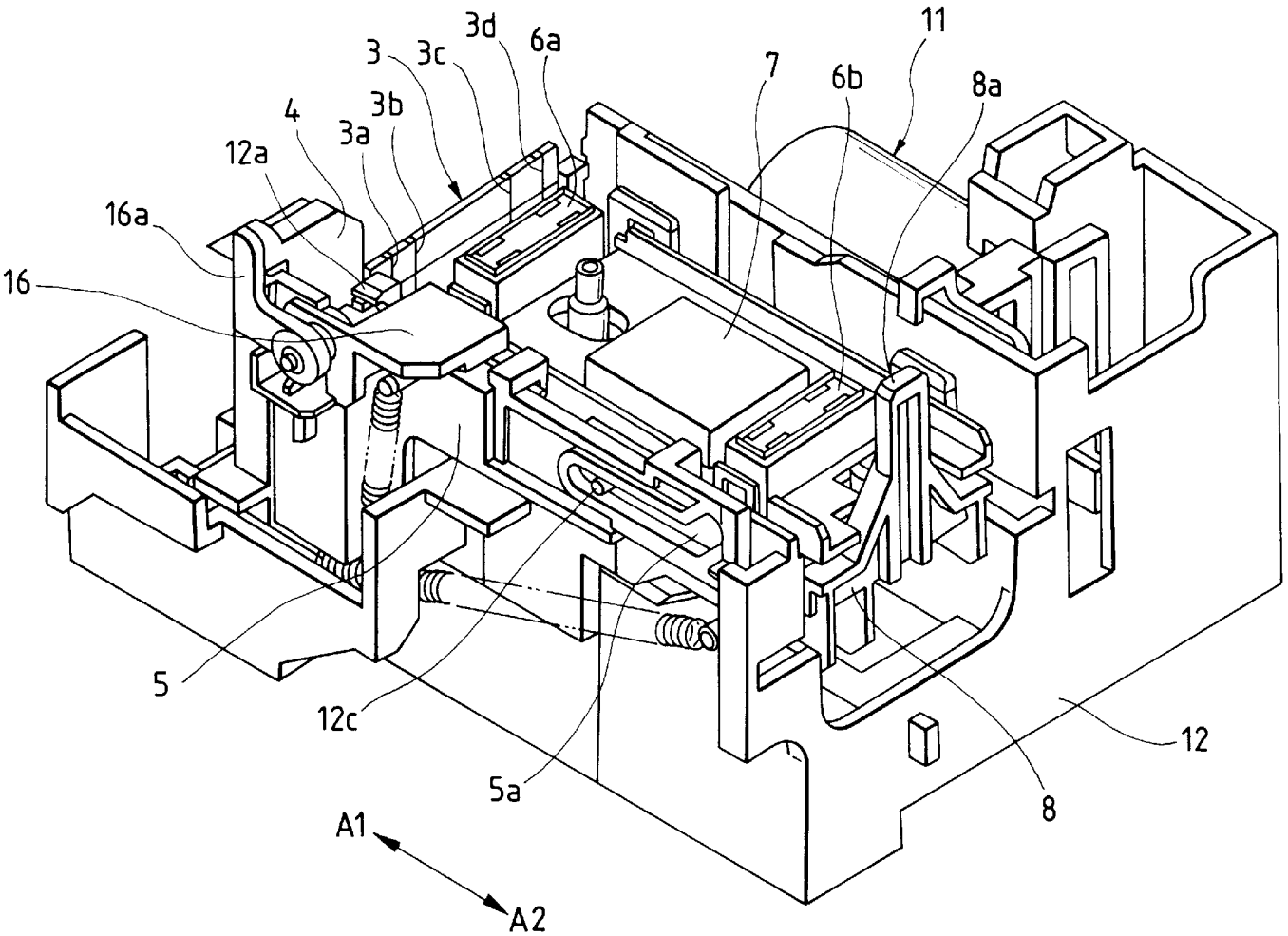
FIG. 3 is a perspective view showing the entire construction of the recovering unit of FIG. 2.
Figure 4:
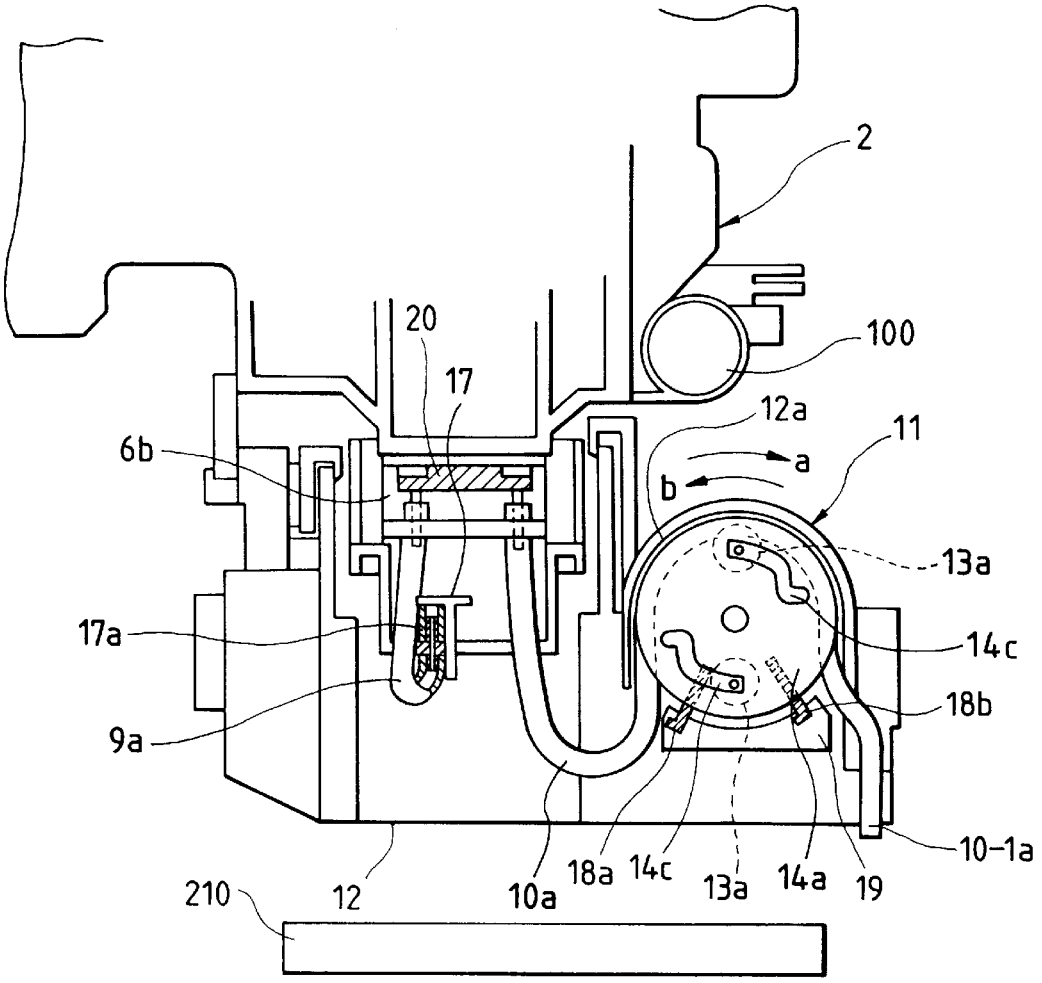
FIG. 4 is a sectional view showing a main portion of the recovering unit of FIG. 2.
Figure 5:
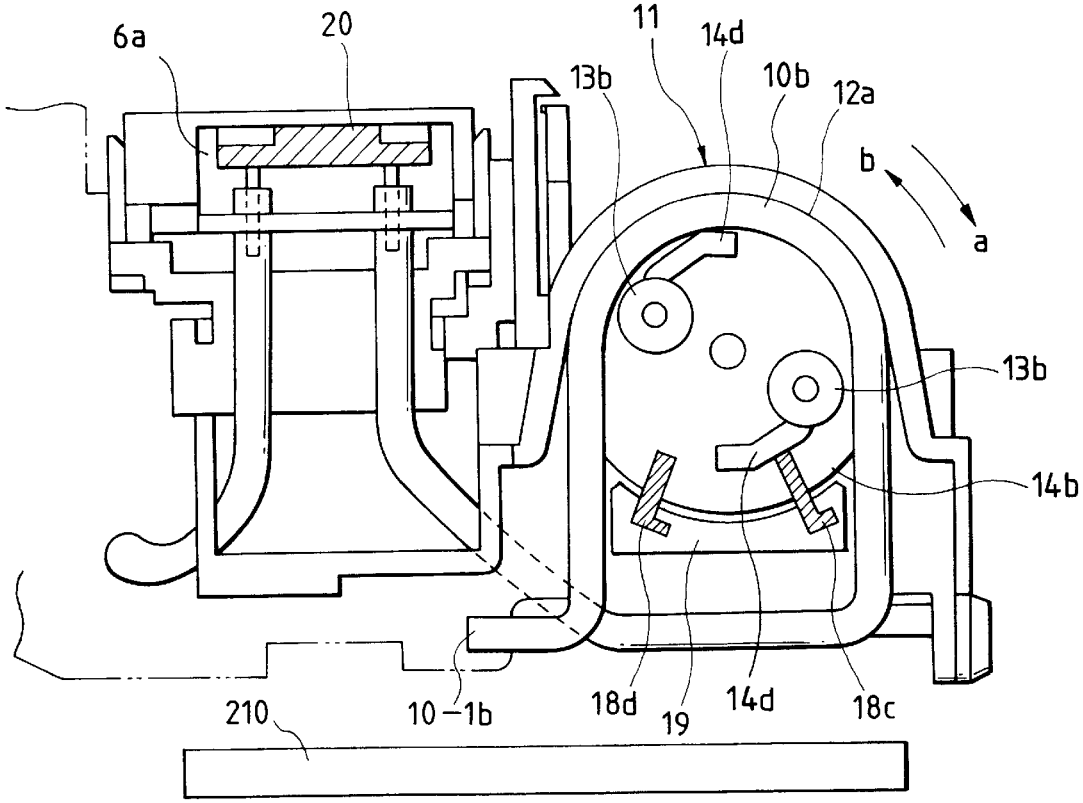
FIG. 5 is a sectional view showing a main portion of the recovering unit of FIG. 2.
Figure 6:
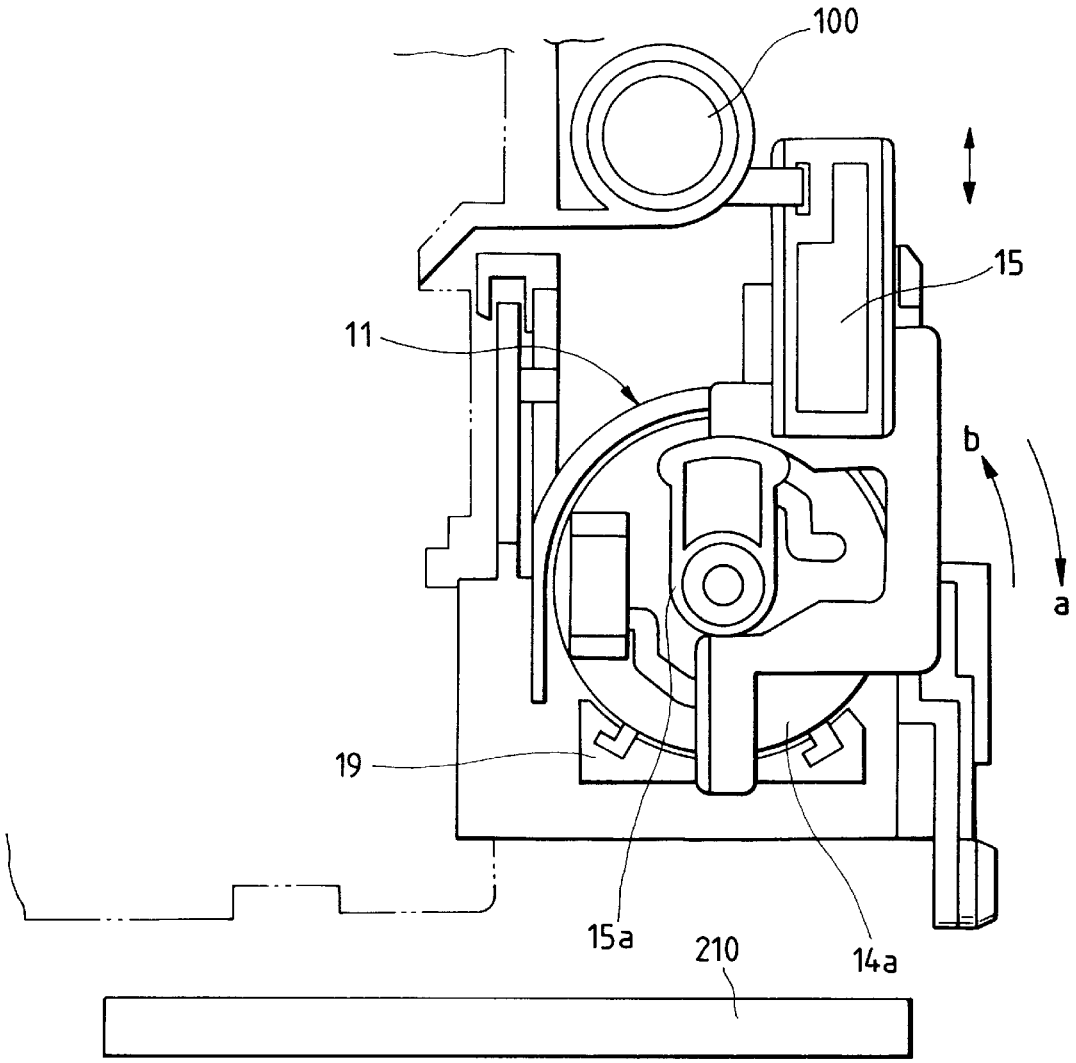
FIG. 6 is a schematic side view of the recovering unit of FIG. 2.
Figure 7:
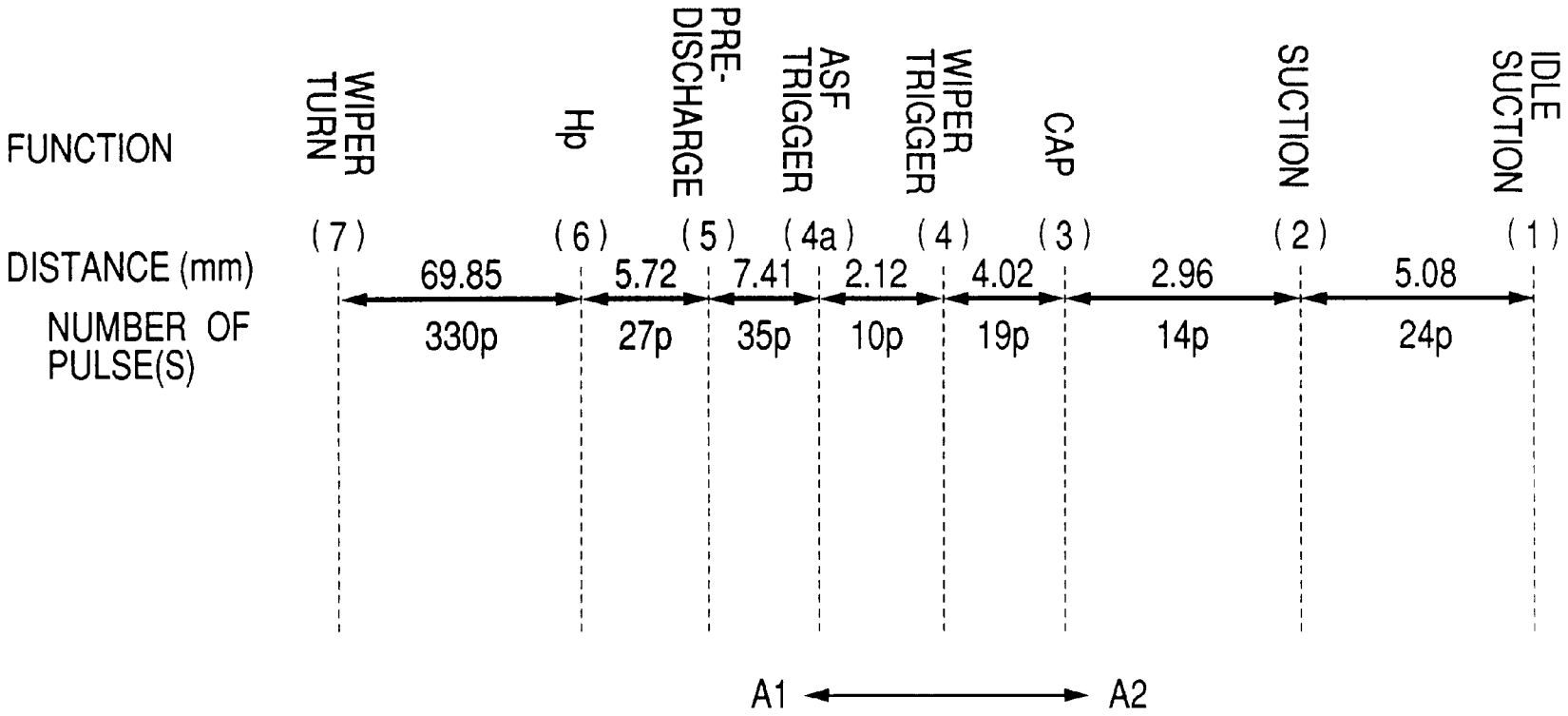
FIG. 7 is an explanatory view for explaining a recovering operation of the recovering unit of FIG. 2.
Figure 8:
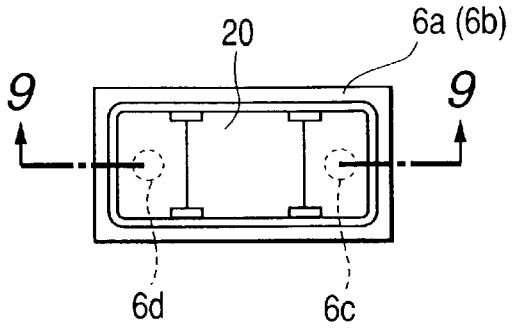
FIG. 8 is a top view of a cap in the recovering unit of FIG. 2.
Figure 9:
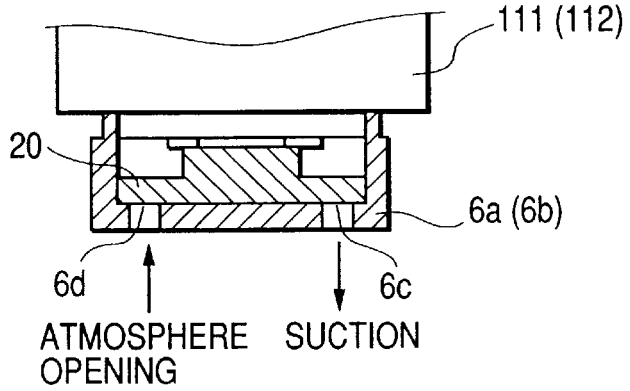
FIG. 9 is a sectional view taken along the line 9—9 in FIG. 8.

FIG. 1 is a perspective view showing the entire construction of an ink jet recording apparatus according to a first embodiment of the present invention, FIG. 2 is a perspective view showing a carriage of FIG. 1 and a recovering unit for a recording head mounted on the carriage, and FIG. 3 is a perspective view showing the entire construction of the recovering unit of FIG. 2. FIGS. 4 and 5 are sectional views showing a main portion of the recovering unit of FIG. 2, FIG. 6 is a schematic side view of the recovering unit of FIG. 2, FIG. 7 is an explanatory view for explaining a recovering operation of the recovering unit of FIG. 2, FIG. 8 is a top view of a cap in the recovering unit of FIG. 2, and FIG. 9 is a sectional view taken along the line 9—9 in FIG. 8.

First of all, a fundamental construction of the recording apparatus according to the first embodiment.

In FIGS. 1 to 3, a carriage 2 can be shifted along a guide shaft 101 in a main scanning direction perpendicular to a recording sheet conveying direction. The carriage 2 is mounted on the guide shaft 101 by inserting a bearing 100 at a rear part of the carriage onto the guide shaft. Two heads of different type are mounted on the carriage 2, and such two heads are deviated from each other, for example by about 4 mm, in the recording sheet conveying direction. One of two heads is a photo-head 111 having tanks for magenta and cyan inks having low density and an ink tank for black ink, and a color head 112 capable of discharging yellow, magenta and cyan inks. By combination of these heads, the recording apparatus can effect printing with six color inks, thereby permitting sharp photograph like printing. Alternatively, by replacing the photo-head 111 by a black head having only an ink tank for black color, text printing can be effected at a high speed or business color can be printed at a high speed.

Further, the ink jet recording apparatus is provided with a recovery base 12 having a cap slider 8 (FIG. 3) for capping two heads mounted on the carriage 2 to effect recovering treatment, which recovery base is located at a predetermined position within a main body of the apparatus near a right side thereof (near the arrow A2).

As shown in FIGS. 2 and 3, the cap slider 8 on the recovery base 12 can be slidingly shifted together with the carriage 2 when a projection 8*a* of the slider is pushed by the moving carriage 2.

The cap slider 8 is provided with a cap holder 7 holding caps 6*a*, 6*b* for covering discharge port forming surfaces of two recording heads 111, 112. The cap holder 7 can be shifted in the direction A2 while being lifted, with the result that the discharge port forming surfaces of the recording heads 111, 112 are capped by the caps 6*a*, 6*b*. Further, there is provided a suction pump (recovery treating means) 11 for generating negative pressure in the caps 6*a*, 6*b* contacted with two recording heads 111, 112 when capped, so that recovering treatment for sucking the ink which does not contribute to image recording from the discharge ports of the recording heads by negative pressure is effected.

Further, the recovery base 12 is provided with a wiper holder base 5, and a wiper 3 is held by a wiper holder 4 provided on the wiper holder base 5. The wiper 3 can clean the discharge port forming surfaces of two recording heads 111, 112. While the wiper holder base 5 is being slid in synchronous with the cap slider 8, it is lifted by a guiding action between a guide groove 5*a* of the base and a pin 12*c* of the recovery base 12. In the illustrated embodiment, the wiper 3 is formed from rubber sheet.

According to the illustrated embodiment, in the recording heads 111, 112, inks can be discharged from discharge ports (discharge downwardly) formed in the discharge port forming surfaces thereof. A plurality of discharge ports are arranged in a line on each discharge port forming surface along a direction transverse to the main scanning direction (shown by the double-headed arrow A1, A2). By repeating the shifting movement of the recording heads 111, 112 in the main scanning direction (A1, A2) and the conveyance of the recording medium (not shown) in a direction perpendicular to the main scanning direction, an image is formed on the recording medium by ink dots. The recording heads 111, 112 may be designed to have electrical/thermal converters for applying thermal energy to discharge the ink from the discharge ports, for example.

A home position HP(6) (FIG. 7) for the recording heads is located at a position rightwardly (toward the direction A2) of and out of a recording area of the recording medium, and predetermined recovering operation is effected in an area between an idle suction position (1) and a wiper turn position (7) including the home position (6). The recording area is located leftwardly (toward the direction A1) of the position (7). In FIG. 7, "DISTANCE (mm)" indicates a shifting distance of the carriage and "NUMBER OF PULSE (S)" indicates the number of pulses of a pulse motor for shifting the carriage. Operating contents in various positions will be described later.

Next, a suction pump 11 for generating negative pressure in the caps contacted with the heads when two recording heads 111, 112 are capped by the caps 6*a*, 6*b* of the cap slider 8 will be explained.

For example, the suction pump 11 is a tube pump disclosed in Japanese Patent Laid-Open No. 8-318624 (1996). In the illustrated embodiment, as shown in FIGS. 4 and 5, has sub-roller holders (roller holding means) 14*a*, 14*b* for two systems. As the sub-roller holders 14*a*, 14*b* are rotated, sub-rollers (rollers) 13*a*, 13*b* of the sub-roller holders 14*a*, 14*b* are shifted while squeezing suction tubes (elastic tubes) 10*a*, 10*b* connected to the caps 6*a*, 6*b* to generate negative pressures in the caps 6*a*, 6*b*, thereby effecting the suction recovery of the recording heads 111, 112.

A construction of the suction pump will be described with reference to FIGS. 4 and 5. As shown in FIG. 4, a tube guide surface (guide member) 12*a* of the recovery base 12 has a semi-circular shape. When the sub-roller holder 14*a* is rotated in a direction shown by the arrow a, the suction sub-roller 13*a* is relatively shifted along a cam 14*c* of the sub-roller holder 14*a* in a direction shown by the arrow b and is held near an outer periphery of the sub-roller holder 14*a* by an end (directing toward the direction b) of the cam 14*c*. In this condition, the suction sub-roller 13*a* is rotated in the direction a together with the sub-roller holder 14*a*. In this case, the suction sub-roller 13*a* squeezes the suction tube 10*a* disposed between the tube guide surface 12*a* of the recovery base and the suction sub-roller 13*a*, thereby generating the negative pressure in the cap 6*b* to which the suction tube 10*a* is connected. In order to ensure that the suction sub-roller 13*a* is positively held near the outer periphery of the cam 14*c*, i.e., that the suction sub-roller 13*a* positively squeezes the suction tube 10*a*, dampers (elastic members) 18*a*, 18*b* are provided in a confronting relation to the tube guide surface 12*a*. The dampers 18*a*, 18*b* are mounted to a pump cover 19 which is supported by the recovery base 12. Further, the dampers 18*a*, 18*b* are located on a rotation path of the sub-roller 13*a*. With this arrangement, as the sub-roller holder 14*a* is rotated in the direction a in FIG. 4, when the suction sub-roller 13*a* contacts with the damper 18*a* or 18*b*, the suction sub-roller 13*a* is always biased toward the outer periphery of the cam 14*c* by an elastic force of the damper to urge the tube 10*a*. When the suction sub-roller 13*a* is released from the suction tube 10*a*, the suction sub-roller tries to shift inwardly from the outer periphery of the cam 14*c* by an elastic force (repelling force) of the suction tube 10*a*. In this case, the suction sub-roller 13*a* may abut against an inner peripheral end of the cam 14*c* to generate collision noise. To avoid this, the damper 18*b* is provided so that the suction sub-roller 13*a* is prevented from shifting up to the inner peripheral end of the cam 14*c*. However, even by adopting such an arrangement, if a position where the suction sub-roller 13*a* is released from the suction tube 10*a* is spaced apart from a position of the damper 18*b*, after the suction sub-roller 13*a* abuts against the damper 18*b*, shock may not be absorbed to generate tremble noise between the suction sub-roller and the cam 14*c*. In the illustrated embodiment, the tube guide surface 12*a* is extended toward a direction perpendicular to a line connecting between the rotation center of the sub-roller holder 14*a* and the position where the suction sub-roller 13*a* is released from the suction tube 10*a*. With this arrangement, a timing for releasing the suction sub-roller 13*a* from the suction tube 10*a* can be delayed, with the result that a distance through which the suction sub-roller 13*a* strikes against the damper 18*b* can be shortened, thereby minimizing the collision noise of the suction sub-roller 13*a*.

Further, the other sub-roller holder 14*b* is rotated in the direction a in FIG. 5, and the suction sub-roller 13*b* is shifted inwardly along a groove-shaped cam 14*d* of the sub-roller holder 14*b* and is rotated together with the sub-roller holder 14*b* at a position where the suction tube 10*b* is not sealingly closed. Accordingly, the interior of the cap 6*a* communicated with the suction tube 10*b* is communicated with the atmosphere.

Conversely, when the sub-roller holder 14*b* is rotated in the direction b in FIG. 5, the suction sub-roller 13*b* is relatively shifted along the cam 14*b* in the direction a and is held near an outer periphery of the sub-roller holder 14*b* by an end (directing toward the direction a) of the cam 14*d*. In this condition, the suction sub-roller 13*b* is rotated in the direction b together with the sub-roller holder 14*b*. In this case, the suction sub-roller 13*b* squeezes the suction tube 10*b* disposed between the tube guide surface 12*a* of the recovery base 12 and the suction sub-roller 13*b*, thereby generating the negative pressure in the cap 6*a* to which the suction tube 10*b* is connected. In order to ensure that the suction sub-roller 13*b* is positively held near the outer periphery of the cam 14*d*, i.e., that the suction sub-roller 13*b* positively squeezes the suction tube 10*b*, dampers (elastic members) 18*c*, 18*d* are provided in a confronting relation to the tube guide surface 12*a*. Similar to the dampers 18*a*, 18*b* shown in FIG. 4, the dampers 18*c*, 18*d* are mounted to the pump cover 19 and are located on a rotation path of the sub-roller 13*b*. With this arrangement, as the sub-roller holder 14*b* is rotated in the direction b in FIG. 5, when the suction sub-roller 13*b* contacts with the damper 18*c* or 18*d*, the suction sub-roller 13*b* is always biased toward the outer periphery of the cam 14*d* by an elastic force of the damper to urge the tube 10*b*. When the suction sub-roller 13*b* is released from the suction tube 10*b*, the suction sub-roller tries to shift inwardly from the outer periphery of the cam 14*d* by an elastic force of the suction tube 10*b*. In this case, the suction sub-roller 13*b* may abut against an inner peripheral end of the cam 14*d* to generate collision noise. To avoid this, the damper 18*d* is provided so that the suction sub-roller 13*b* is prevented from shifting up to the inner peripheral end of the cam 14*d*. However, even by adopting such an arrangement, if a position where the suction sub-roller 13*b* is released from the suction tube 10*b* is spaced apart from a position of the damper 18*d*, after the suction sub-roller 13*b* abuts against the damper 18*d*, shock may not be absorbed to generate tremble noise between the suction sub-roller and the cam 14*d*. Similar to the above, in the illustrated embodiment, the tube guide surface 12*a* is extended toward a direction perpendicular to a line connecting between the rotation center of the sub-roller holder 14*b* and the position where the suction sub-roller 13*b* is released from the suction tube 10*b*. With this arrangement, a timing for releasing the suction sub-roller 13*b* from the suction tube 10*b* can be delayed, with the result that a distance through which the suction sub-roller 13*b* strikes against the damper 18*d* can be shortened, thereby minimizing the collision noise of the suction sub-roller 13*b*.

The other sub-roller holder 14*a* is rotated in the direction b in FIG. 4, and the suction sub-roller 13*a* is shifted along the cam 14*c* of the sub-roller holder 14*a* and is held radially inwardly of the sub-roller holder 14*a* by an end (directing toward the direction a in FIG. 4) of the cam 14*c*. In this condition, the suction sub-roller is rotated together with the sub-roller holder 14*a* in the direction b in FIG. 4. In this case, the suction sub-roller 13*a* is rotated to a position where the suction tube 10*a* is not sealingly closed, with the result that the suction tube 10*a* is not squeezed. Thus, the negative pressure is not generated in the suction tube 10*a* and the interior of the cap 6*b* communicated with the suction tube 10*a* is communicated with the atmosphere.

Further, when the suction pump 11 is operated in a normal direction (direction b in FIGS. 4 to 6), a carriage lock 15 shown in FIG. 6 is lifted via a friction member 15*a* to lock movement of the carriage 2, and, when the suction pump 11 is operated in a reverse direction (direction a in FIGS. 4 to 6), the carriage lock is lowered via the friction member 15*a* to unlock the movement of the carriage 2.

Next, an arrangement around the caps 6*a*, 6*b* will be explained.

As shown in FIG. 3, the caps 6*a*, 6*b* are held by the cap holder 7, and the cap holder 7 is held by the cap slider 8 via a cap spring (not shown). When the carriage 2 is shifted rightwardly (toward the direction A2) beyond the position shown in FIG. 3 (corresponding to the position (3) (CAP) in FIG. 7), the cap holder 7 is lifted to cause the caps 6*a*, 6*b* to cap the recording heads 111, 112.

Each of the caps 6*a*, 6*b* is provided with two holes, and one of two holes in the cap 6*a* is connected to one end of the suction tube 10*b*, and the other hole is connected to one end of an atmosphere communicating tube 9*b*. One of two holes in the cap 6*b* is connected to one end of the suction tube 10*a*, and the other hole is connected to one end of an atmosphere communicating tube 9*a*.

The other ends of the atmosphere communicating tube 9*a*, 9*b* are inserted into the cap slider 8, and valves 17 are attached to such the other ends via packing members 17*a*. Each valve 17 is opened and closed by its sliding movement when it is pushed by the cap slider 8, so that it is closed at a position (2) in FIG. 7 and is opened at a position (1). Accordingly, in the position (position (2) in FIG. 7) where the heads are capped and the atmosphere communicating tube 9*a*, 9*b* are closed, in accordance with the rotational directions of the sub-roller holders 14*a*, 14*b* obtained by the suction pump 11, the recovering operation for sucking the ink from the discharge ports of the recording heads 111, 112 through the suction tubes 10*a*, 10*b* is permitted. Further, in the position (position (1) in FIG. 7) where the heads are capped and the atmosphere communicating tube 9*a*, 9*b* are opened, in accordance with the rotational direction of the suction pump 11, the idle suction for sucking the residual ink in the caps 6*a*, 6*b* and the suction tubes 10*a*, 10*b* through the suction tubes 10*a*, 10*b* is permitted.

The other ends of the suction tubes 10*a*, 10*b* act as ink discharge ends 10-1*a*, 10-1*b*, and the ink discharged from the ink discharge ends 10-1*a*, 10-1*b* is sent to a waste ink processing member 210 disposed below the ink discharge ends and are processed there.

FIGS. 8 and 9 show the caps 6*a*, 6*b* in detail, where FIG. 8 is a top view and FIG. 9 is a sectional view taken along the line 9—9 in FIG. 8, showing a condition that the discharge ports of the recording heads 111, 112 are sealingly closed by the caps (elastic members) 6*a*, 6*b*. As mentioned above, each of the caps 6*a*, 6*b* is provided at its bottom with two communication holes which act as an ink suction opening 6*c* and an atmosphere communicating opening 6*d*, respectively. In order to prevent scattering of the ink toward the discharge ports of the recording heads 111, 112 and to suck the ink remaining around the discharge ports of the recording heads 111, 112, an ink absorbing members 20 made of porous material are disposed within the caps 6*a*, 6*b*.

The ink absorbing members 20 are disposed to contact with inner surfaces of the caps 6*a*, 6*b* and abut against the ink suction openings 6*c* and the atmosphere communicating openings 6*d*. Areas of each ink absorbing member 20 opposed to the ink suction hole and the atmosphere communicating hole of the cap 6*a* or 5*b* have thicknesses thinner than the other area. The ink suction openings have substantially the same diameters at areas thereof contacted with the ink absorbing members. The ink suction opening and the atmosphere communicating opening are symmetrically arranged in the vicinity of both longitudinal ends of the cap member. A central area of the ink absorbing member with respect to the longitudinal direction of the cap member has a thickness greater than those of other areas. The longitudinal direction of the cap member substantially coincides with a direction along which the plurality of discharge ports are arranged in a line.

In the illustrated embodiment, the thickness of the ink absorbing member is selected to 2.6 mm, and thickness of the areas of the ink absorbing member opposed to the ink suction hole and the atmosphere communicating hole of the cap member is selected to 1.3 mm.

With this arrangement, when the ink is absorbed from the recording heads 111, 112, the amount of residual ink in the ink absorbing member 20 is decreased. Even when the apparatus are left as it is for a long term without effecting the recording, occurrence of ink solidification and clogging of the ink absorbing members 20 can be suppressed. If ink solidification or clogging should be partially generated in the ink absorbing members, after the ink starts to flow once, solidified or clogged ink becomes apt to be solved again from the thinner areas of the ink absorbing members. Further, after the ink suction from the recording heads 111, 112, when the interior of the caps 6*a*, 6*b* are communicated with the atmosphere, the atmosphere can easily be communicated with the interior of the ink absorbing members 20, thereby effecting the suction of the residual ink (idle suction) positively.

In a position (position (5) in FIG. 7) where the caps 6*a*, 6*b* are spaced apart from and disposed below the recording heads 111, 112, pre-discharge for discharging the ink not contributing the recording from the recording heads 111, 112 can be performed. Further, in a position (4) a in FIG. 7 ASF (auto sheet feeder) trigger for automatically feeding the recording media can be outputted.

Further, the cap slider 8 and the wiper holder base 5 are operated in synchronous with each other, so that, when the carriage 2 is situated rightwardly (toward the direction A2) beyond the position (4) in FIG. 7, the wiper holder base 5 is lifted, by the guide groove 5*a* and the pin 12*c* of the recovery base 12, up to a position where the wiper holder base can abut against the recording heads 111, 112, with the result that the wiper lock 16 is engaged by the pawl of the recovery base 12. That is to say, when the carriage 2 is shifted from the left to the right beyond the position (4) in FIG. 7, at his position (4), the wiper 3 is held at a position where the wiper can abut against the head. On the other hand, when the carriage 2 is shifted from the right to the left beyond the position (7) in FIG. 7, at his position (7), the wiper lock 16 is unlocked, with the result that the wiper 3 does not contact with the heads 111, 112.

Next, a series wiping operation will be explained.

First of all, when the recording apparatus is powered ON, in the locking condition of the carriage lock 15 as shown in FIG. 6, the suction pump 11 is rotated in the normal direction (direction a) by a drive source (not shown), with the result that the locking condition of the carriage 2 attained by the carriage lock 15 is released or unlocked. After the locking condition of the carriage lock 15 is released, the carriage 2 is shifted to the wiper turn position (7) in FIG. 7. The wiping start (trigger) position (4) is located between the cap position (3) and the recording waiting position (PII) 5. While the carriage 2 is being shifted to the recording waiting position (6), the caps 6*a*, 6*b* are opened and the wiping operation for the recording heads 111, 112 is effected by the wiper 3. Further, when the carriage 2 is shifted up to the position (7) in FIG. 7, the projection of the carriage 2 abuts against the wiper lock lever 16*a* to disengage the wiper lock 16 from the pawl of the recovery base 12, with the result that the wiper 3 is shifted downwardly to be retarded from the recording heads 111, 112. In this condition, the wiper 3 does not abut against the recording heads 111, 112. As shown in FIG. 3, the wiper 3 is provided with four slits 3*a*, 3*b*, 3*c*, 3*d*. The slit 3*a* is formed at a position corresponding to one of opposed sides of the recording head 112, the slit 3*c* is formed at a position corresponding to the other of opposed sides of the recording head 112, the slit 3*b* is formed at a position corresponding to one of opposed sides of the recording head 111, the slit 3*c* is formed at a position corresponding to the other of opposed sides of the recording head 111. In the illustrated embodiment, the slits 3*a*, 3*b*, 3*c*, 3*d* are straightly formed in a predetermined area of the sheet-shaped wiper 3 directing from an upper end to a lower end thereof at a position opposed to the opposed sides of the recording head 112 and the opposed sides of the recording head 111.

Second Embodiment

Figure 10:
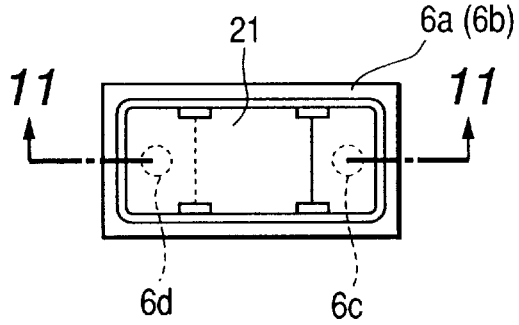
FIG. 10 is a top view of a cap in a recovering unit of an ink jet recording apparatus according to a second embodiment of the present invention.
Figure 11:
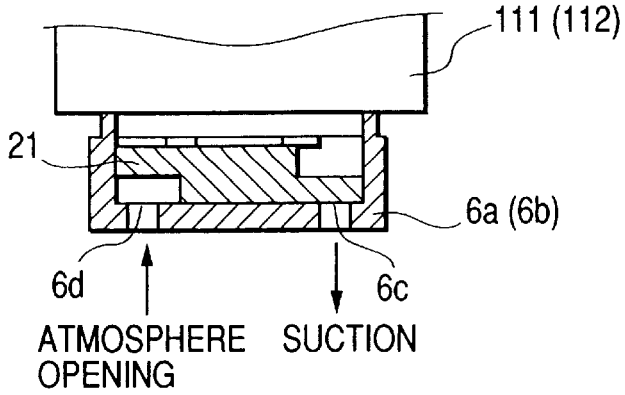
FIG. 11 is a sectional view taken along the line 11—11 in FIG. 10.

Now, a second embodiment of the present invention will be explained with reference to FIGS. 10 and 11, regarding features different from those in the first embodiment. FIGS. 10 and 11 show a cap of a recovering unit of an ink jet recording apparatus according to the second embodiment of the present invention, where FIG. 10 is a top view of the cap and FIG. 11 is a sectional view taken along the line 11—11 in FIG. 10.

As shown in FIGS. 10 and 11, in the recovering unit of the ink jet recording apparatus according to the second embodiment, only the configuration of the ink absorbing member differs from that in the first embodiment. That is to say, in the first embodiment, while an example that the ink absorbing members 20 abut against the ink suction holes and the atmosphere communicating holes formed in the bottoms of the caps 6*a*, 6*b* was explained, in the second embodiment, as shown in FIG. 11, an ink absorbing member 21 abuts against the ink suction hole but does not abut against the atmosphere communicating hole. Further, similar to the first embodiment, a thickness of areas of the ink absorbing member 21 opposed to the ink suction hole and the atmosphere communicating hole of the cap 6*a* or 6*b* is thinner than a thickness of the other area.

With the arrangement as mentioned above, after the sucking of ink, when the ink remaining in the caps is sucked (idle suction) by communicating the interior of the caps with the atmosphere, since an area of each ink absorbing member 21 directly contacted with the atmosphere is increased, more effective ink absorption can be achieved.

Figure 12:
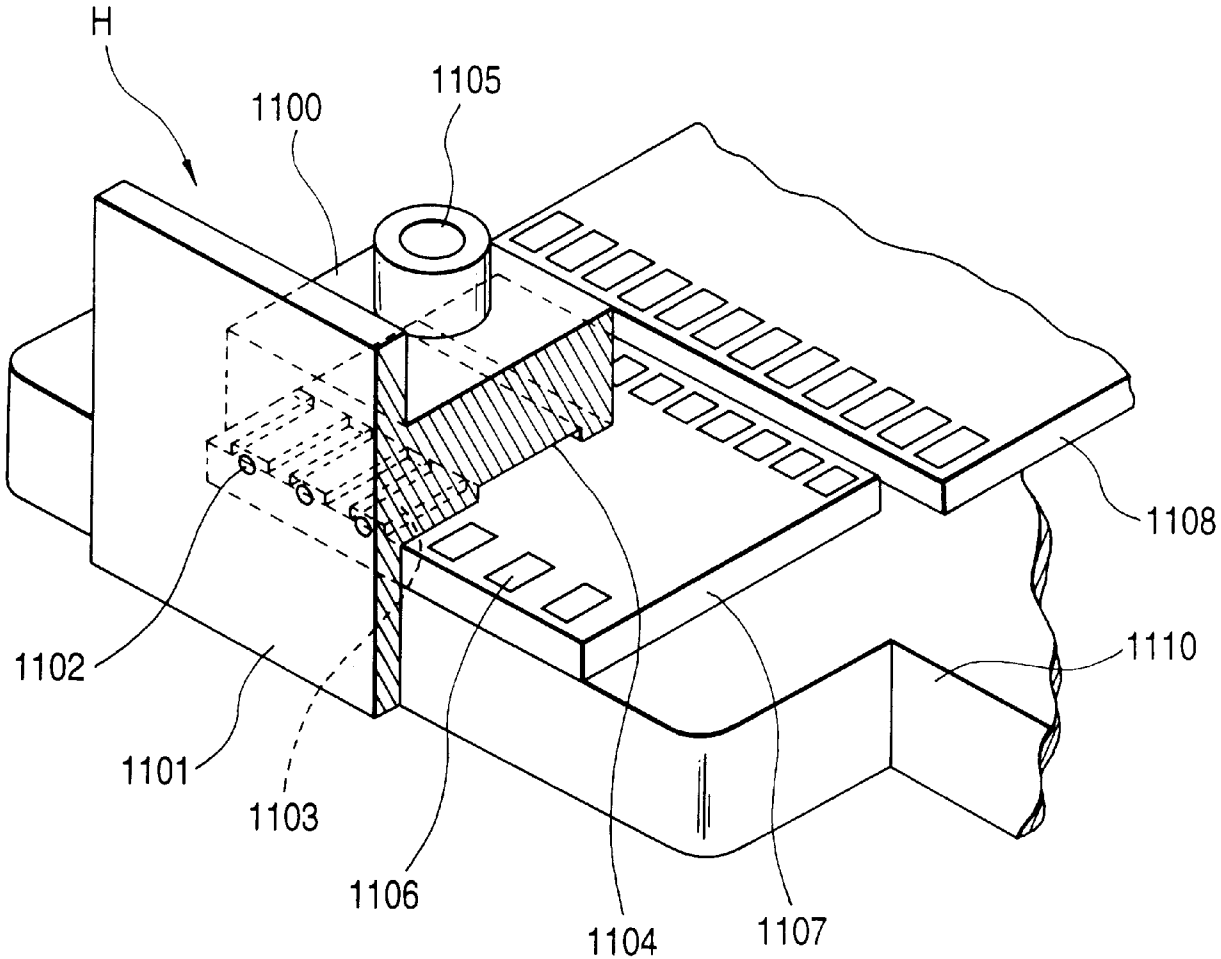
FIG. 12 is a sectional perspective view showing an ink jet recording head available to an embodiment of the present invention.

Now, a general construction of the above-mentioned ink jet recording head will be described with reference to FIG. 12.

A top plate 1100 forming a part of the ink jet recording head H is formed from resin material and integrally includes a top plate member having a liquid chamber 1104 for reserving recording liquid and a plurality of liquid passages 1103, a discharge port forming member 1101 having a plurality of discharge ports (orifices) 1102 communicated with the plurality of liquid passages 1103, respectively, and a recording liquid supplying port member 1105. Further, in a heater board (element substrate) 1107, a plurality of heaters (electrical/thermal converters) 1106 disposed on a silicone substrate and electrical wirings (not shown) made of aluminum or the like for supplying electricity to the heaters are formed by a well-known film forming technique, and the heater board is positioned and secured onto a base plate 1110 by a well-known die-bonding technique. A wiring substrate 1108 is provided with wirings connected to the wirings of the heaters board 1107 by a well-known wire-bonding technique, and a plurality of pads 1109 disposed at ends of the wirings and adapted to receive electrical signals from a main body of the image forming apparatus. The top plate 1100 and the heater board 1107 are joined together in such a manner that the liquid passages 1103 are opposed to the heaters 1106 to form an assembly, and the assembly is secured to the base plate 1110 together with the wiring substrate 1108, thereby forming the ink jet recording head H.

What is claimed is:

1. An ink jet recording apparatus comprising:

a cap member capable of sealing a discharge port for discharging ink and being provided at its bottom with an ink suction opening and an atmosphere communicating opening;

an ink absorbing member disposed within said cap member;

a suction pump communicated with said ink suction opening; and an atmosphere communicating valve communicated with said atmosphere communicating opening;

wherein a plurality of areas of said ink absorbing member are opposed to said ink suction opening and said atmosphere communicating opening, said areas are thinner than a remaining area of said ink absorbing member, and said ink absorbing member abuts against said ink suction opening.

2. An ink jet recording apparatus according to claim 1, wherein said ink absorbing member abuts against said atmosphere communicating opening.

3. An ink jet recording apparatus according to claim 1, wherein said ink absorbing member does not abut against said atmosphere communicating opening.

4. An ink jet recording apparatus according to claim 1, wherein said ink suction opening has a substantial constant diameter in a vicinity of an area where said ink suction opening abuts against said ink absorbing member.

5. An ink jet recording apparatus according to claim 1, wherein said cap member has a longitudinal shape and a pair of longitudinal ends which are opposed to one another in a longitudinal direction, and wherein said ink suction opening and said atmosphere communicating opening are disposed symmetrically in a vicinity of both longitudinal ends of said cap member.

6. An ink jet recording apparatus according to claim 1, wherein a central area of said ink absorbing member in a longitudinal direction of said cap member has a thickness greater than those of other areas.

7. An ink jet recording apparatus according to claim 5 or 6, further comprising a plurality of discharge ports arranged in a longitudinal direction, wherein said cap member has a shape which substantially coincides with the longitudinal direction along which the plurality of discharge ports are arranged.

8. An ink jet recording apparatus according to claim 1, wherein said cap is capable of sealing said discharge port which is provided on a recording head having an electrical/thermal converter for generating thermal energy used for discharging the ink from said discharge port.

9. A cap for an ink jet recording apparatus, comprising:

a cap member capable of sealing a discharge port for discharging ink and being provided at its bottom with an ink suction opening communicated with a suction pump and an atmosphere communicating opening communicated with an atmosphere communicating valve; and an ink absorbing member disposed within said cap member;

wherein a plurality of areas of said ink absorbing member are opposed to said ink suction opening and said atmosphere communicating opening, said areas are thinner than a remaining area of said ink absorbing member, and said ink absorbing member abuts against said ink suction opening.

10. A cap according to claim 9, wherein said ink absorbing member abuts against said atmosphere communicating opening.

11. A cap according to claim 9, wherein said ink absorbing member does not abut against said atmosphere communicating opening.

12. A cap according to claim 9, wherein said ink suction opening has a substantially constant diameter in a vicinity of an area where said ink suction opening abuts against said ink absorbing member.

13. A cap according to claim 9, wherein said cap member has a longitudinal shape and a pair of longitudinal ends which are opposed to one another in a longitudinal direction, and wherein said ink suction opening and said atmosphere communicating opening are disposed symmetrically in a vicinity of both longitudinal ends of said cap member.

14. A cap according to claim 9, wherein a central area of said ink absorbing member in a longitudinal direction of said cap member has a thickness greater than those of other areas.

* * * * *

UNITED STATES PATENT AND TRADEMARK OFFICE

CERTIFICATE OF CORRECTION

PATENT NO. : 6,179,404 B1
DATED : January 30, 2001
INVENTOR(S) : Kawarama et al.

It is certified that error appears in the above-identified patent and that said Letters Patent is hereby corrected as shown below:

Column 10,
Line 28, "substantial" should read -- substantially --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*